US005310458A

United States Patent [19]

Lundgren et al.

[11] Patent Number: 5,310,458

[45] Date of Patent: * May 10, 1994

[54] PROCESS FOR BLEACHING LIGNOCELLULOSE-CONTAINING PULPS

[75] Inventors: Per G. Lundgren, Väröbacka; Lillemor K. Holtinger, Nödinge; Jiri J. Basta, Partille; Marie R. Samuelsson, Stenungsund, all of Sweden

[73] Assignee: EKA Nobel AB, Sweden

[ * ] Notice: The portion of the term of this patent subsequent to Sep. 1, 2009 has been disclaimed.

[21] Appl. No.: 813,058

[22] Filed: Dec. 23, 1991

Related U.S. Application Data

[63] Continuation of Ser. No. 533,409, Jun. 5, 1990, abandoned.

[30] Foreign Application Priority Data

Jun. 6, 1989 [SE] Sweden ..... 8902058-0
Apr. 23, 1990 [SE] Sweden ..... 9001448-1

[51] Int. Cl.[5] ..... B21C 3/00

[52] U.S. Cl. ..... 162/78; 162/60; 162/65; 162/76

[58] Field of Search ..... 162/76, 60, 65, 78

[56] References Cited

U.S. PATENT DOCUMENTS

| | | | |
|---|---|---|---|
| 3,251,731 | 9/1966 | Gard | 162/78 |
| 3,865,685 | 2/1975 | Hebbel et al. . | |
| 4,222,819 | 9/1990 | Fossum et al. | 162/78 |
| 4,259,149 | 3/1981 | Jaszka et al. | 162/29 |
| 4,259,150 | 3/1981 | Prough | 162/40 |
| 4,268,350 | 5/1981 | Månsson | 162/29 |
| 4,459,174 | 7/1984 | Papageorges | 162/76 |
| 4,675,076 | 6/1987 | Darlington | 162/78 |
| 4,732,650 | 3/1988 | Michalowski | 162/76 |
| 4,826,568 | 5/1989 | Gratzl | 162/76 |
| 4,874,521 | 10/1989 | Newman et al. | 162/29 |
| 4,946,556 | 8/1990 | Prough . | |

FOREIGN PATENT DOCUMENTS

| | | | |
|---|---|---|---|
| 57944/86 | 12/1986 | Australia . | |
| 14067/88 | 6/1988 | Australia . | |
| 575636 | 5/1959 | Canada | 162/78 |
| 946107 | 4/1974 | Canada | 162/78 |
| 1080406 | 7/1980 | Canada . | |
| 1206704 | 7/1986 | Canada | 162/78 |
| 285530 | 3/1988 | European Pat. Off. | 162/78 |
| 3620980 | 1/1988 | Fed. Rep. of Germany . | |
| 903429 | 5/1980 | U.S.S.R. | 162/78 |

OTHER PUBLICATIONS

Modern Pulp and Paper Making, 3rd Edition, New York, Reinhold Publishing Corp., 1957, pp. 238–239.

Fennell, F. L., "Hydrogen Peroxide for Bleaching Kraft Pulp", TAPPI, vol. 51, No. 1, (Jan. 1968), pp. 62A–66A.

Smeds et al., "Formation and Degradation of Mutagens in Kraft Pulp Mill Water Systems", Nordic Pulp and Paper Research Journal No. 3/1990, pp. 142–147.

J. Böttger et al., "Das Papier", vol. 40, 1986, No. 10A, pp. V25–V33.

Anderson et al., (TAPPI), vol. 63, No. 4, pp. 111–115, 1980.

Gellerstedt et al., Journal of Wood Chemistry and Technology, vol. 2, No. 3, pp. 231–250 (1982).

R. D. Spitz, Tappi Journal, vol. 44, No. 10, pp. 731–734 (1961).

C.-J. Alfthan et al., Svensk Papperstidning, (Swedish Paper Journal), No. 15.

Böttger et al., "Dechlorination and Biological Treatment of Chlorinated Organic Substances", Fourth International Symposium on Wood and Pulping Chemistry, Apr. 27–30, 1987, Paris, France, pp. 171–174.

*Primary Examiner*—Peter Chin

*Assistant Examiner*—Brenda Lamb

*Attorney, Agent, or Firm*—Burns, Doane, Swecker & Mathis

[57] ABSTRACT

The invention relates to a process for bleaching chemically delignified lignocellulose-containing pulp, to render more efficient a peroxide-containing treatment stage, by treating the pulp with a complexing agent before the peroxide step, so that the trace metal profile of the pulp is altered by the treatment with the complexing agent, in the absence of sulphite, at a pH in the range from 3.1 up to 9.0 and at a temperature in the range from 10° C. up to 100° C., whereupon, in a subsequent step, the treatment with a peroxide-containing substance is carried out at a pH in the range from 7 up to 13, said two-step treatment being carried out at an optional position in the bleaching sequence applied to the pulp.

9 Claims, No Drawings

PROCESS FOR BLEACHING LIGNOCELLULOSE-CONTAINING PULPS

This application is a continuation of application Ser. No. 07/533,409, filed Jun. 5, 1990 now abandoned.

The present invention relates to a process for bleaching lignocellulose-containing pulps, to render more efficient a peroxide-containing treatment stage by treating the pulp, before the peroxide stage, with a complexing agent under neutral conditions and at elevated temperature, in the absence of sulphite, whereupon, in a subsequent stage, the treatment with a peroxide-containing substance is carried out under alkaline conditions.

Lignocellulose-containing pulps refer to chemical pulps from softwood and/or hardwood, delignified according to the sulphite, sulphate, soda or organosolv process, or modifications and/or combinations thereof. Before the bleaching with chlorine-containing chemicals, the pulp may also have been subject to delignification in an oxygen stage.

BACKGROUND

Bleaching of chemical pulps is mainly carried out with chlorine-containing bleaching agents, such as chlorine, chlorine dioxide and hypochlorite, resulting in chloride-containing, corrosive spent bleach liquors which therefore are difficult to recover and thus results in detrimental discharges to the environment. Nowadays, there is a strive towards the use of, to the greatest possible extent, bleaching agents poor in or free from chlorine, so as to reduce the discharges and recover the spent liquors. One example of such a bleaching agent, which recently has come into increasing use, is oxygen. By using an initial alkaline oxygen stage in a multi-stage bleaching sequence of, for example, sulphate pulp, it is possible to reduce the discharge from bleach plants by more than half the original amount, since spent oxygen bleach liquor not containing chlorine is recoverable. However, after an initial oxygen bleaching stage, the remaining lignin left in the pulp is about half of the amount remaining after the delignification in the cooking process, which thus has to be dissolved out of the pulp by further bleaching by means of chlorine-containing bleaching agents. Therefore, there is a tendency to further reduce, by means of various pretreatments and prebleaching stages, the amount of lignin that has to be removed by chlorine-containing bleaching.

Other types of bleaching chemicals which are suitable from a recovery point of view, include peroxides, e.g. inorganic peroxides, such as hydrogen peroxide and sodium peroxide, and organic peroxides, such as peracetic acid. In actual practice, hydrogen peroxide is not used to any appreciable extent in the first step of a bleaching sequence to obtain an initial reduction of lignin and/or an increase in brightness, because of the large amounts of added hydrogen peroxide which are necessary.

Thus, large amounts of hydrogen peroxide must be added in alkaline hydrogen peroxide treatment to reach a satisfactory dissolution of lignin, since such a treatment gives a high degree of decomposition of the hydrogen peroxide, resulting in considerable costs for chemicals. In acidic hydrogen peroxide treatment, the same dissolution of lignin can be obtained as in alkaline treatment with a much lower consumption of hydrogen peroxide. However, the acidic treatment results in a substantial drop in the viscosity of the pulp, i.e. the decomposition products of the hydrogen peroxide, at low pH values attack not only the lignin, but also the cellulose, so that the length of the carbohydrate chains is reduced, resulting in impaired strength properties of the pulp. Furthermore, an intensely acidic treatment is inconvenient since it involves the precipitation of lignin already dissolved, the resin becomes sticky and difficult to dissolve, and problems arise regarding the recovery of the acidic spent liquor.

According to SE-A 420,430, the drop in the viscosity in an acidic hydrogen peroxide treatment can be avoided by carrying it out in the presence of a complexing agent, such as DTPA (diethylenetriaminepentaacetic acid), at a pH of from 0.5 to 3.0. This treatment step is followed by an alkaline extraction step for removal of dissolved lignin, without intermediate washing.

Furthermore, it is known to remove trace metals from cellulose pulps by using the combined effects of sodium sulphite ($SO_2$ in an alkaline solution) and DTPA before the peroxide treatment step, see Gellerstedt et al, Journal of Wood Chemistry and Technology, 2(3), 231–250 (1982). By this, complexes of DTPA and a reduced metal ion are formed and which can be removed from the pulp by washing, whereupon a hydrogen peroxide treatment with improved efficiency can be carried out.

For mechanical pulps, it is common practice to include pretreatment with complexing agents in a bleaching sequence, prior to an alkaline hydrogen peroxide stage, see e.g. EP 285,530, U.S. Pat. No. 3,251,731 and SU 903,429. In this case, however, the aim is purely to bleach the pulp and not to delignify it. For this purpose, the activity of hydrogen peroxide is controlled by the addition of silicates, such as sodium silicate, so that on the whole it is the content of chromophoric groups which is reduced. Failure to include silicate in the bleaching composition will prevent the mechanical pulp from gaining the best obtainable brightness, even if the charge of hydrogen peroxide is substantially increased, e.g. by 50% above the normally added quantity. For chemical pulps, the addition of silicates is avoided, since this would only increase the cost for chemicals without any positive effect and make it impossible to easily recover the waste liquors. Furthermore, for chemical pulps the increase in brightness is definitely influenced by a change of pH in the complexing stage, whereas this is not the case when treating mechanical pulps with complexing agents.

TECHNICAL PROBLEM

A normal bleaching sequence for a delignified lignocellulose-containing pulp, e.g sulphate pulp from softwood, is O C/D E D E D (O=oxygen stage, C/D=chlorine/chlorine dioxide stage, E=alkali extraction stage, D=chlorine dioxide stage). Thus, the purpose of various pretreatment stages is to reduce the lignin content before the first chlorine-containing stage, thus reducing the requirement for chlorine and lowering the TOCl value (TOCl=total organic chlorine) in the spent bleach liquor. Since previously known pretreatment methods either comprise acidic treatment steps or comprise unacceptable additives from a recovery point of view during the treatment, the possibility of obtaining a more closed system in the bleach plant is rather limited. To overcome these technical problems in the process expensive equipment need to be set up.

There have been discussions on the possibility to reduce the TOCl value by replacing the C/D stage in a common bleaching sequence by a D stage, because such a step results in less detrimental discharge products compared to a C/D stage, due to the elimination of molecular chlorine. This, however, requires large amounts of charged chlorine dioxide in this stage to reduce the lignin content to the required low level prior to the following bleaching stages. The present invention, therefore, aims at solving the problem by modifying, in another fashion, an existing bleaching sequence so that the lowest possible TOCl values can be obtained and still give a product of the same or even improved quality.

THE INVENTION

The invention relates to a treatment method in which an initial, chlorine free delignification can be substantially increased without any major investments. This treatment is carried out in two steps: the first step comprising an alteration of the trace metal profile of the pulp by treatment under neutral conditions and at elevated temperature with a complexing agent, and the second step comprising the realization of a peroxide treatment under alkaline conditions, this two-step treatment resulting in a bleaching process which is much less harmful to the environment in that the amount of chlorine-containing chemicals in said process is substantially reduced.

The invention thus concerns a process for treating lignocellulose-containing pulp as disclosed in the claims. According to the invention, this process for bleaching the pulp relates to a method to render more efficient a peroxide-containing treatment stage by treating, before such a stage, the pulp with a complexing agent, thereby altering the trace metal profile of the pulp by treatment with the complexing agent, there being no sulphite present, at a pH in the range from 3.1 up to 9.0 and at a temperature in the range from 10° C. up to 100° C. In a subsequent stage, the treatment with a peroxide-containing substance is carried out at a pH in the range from 7 up to 13, said two-step treatment being carried out at an optional position in the bleaching sequence applied to the pulp.

The process according to the invention is preferably used in such bleaching of the treated pulp, where the bleaching sequence comprises an oxygen stage. The position chosen for executing the treatment according to the invention may be either immediately after the delignification of the pulp, i.e. before an optional oxygen stage, or after the oxygen stage in a bleaching sequence comprising such a stage.

In the process according to the invention, the first step is suitably carried out at a pH from 4 to 8, especially suitably at a pH from 5 to 8, preferably at a pH from 5 to 7, especially preferably at a pH from 6 to 7, and the second step preferably at a pH from 8 to 12.

The complexing agents employed principally comprise carboxylic acids, polycarboxylic acids, nitrogenous polycarboxylic acids, preferably diethylenetriaminepentaacetic acid (DTPA) or ethylenediaminetetraacetic acid (EDTA), or phosphonic acids or polyphosphates. The peroxide-containing substance used is preferably hydrogen peroxide or hydrogen peroxide+oxygen.

The treatment according to the invention preferably comprises a washing stage between the two treatment stages, such that the complex bound metals are removed from the pulp suspension before the peroxide stage. Furthermore, after this two-step treatment, the pulp may be subjected to a final bleaching to obtain the desired brightness. In conventional bleaching sequences, the final bleaching comprises charges of chlorine and chlorine dioxide. These charges may be wholly or partly excluded from the bleaching process, provided the pulp has been treated with the two-step process according to the invention after an oxygen stage.

In the two-step treatment according to the invention, the first step is carried out at a temperature of from 10° to 100° C., suitably from 26° to 100° C., preferably from 40° to 90° C., during from 1 to 360 min., preferably from 5 to 60 min., and the second step is carried out at a temperature of from 50° to 130° C., suitably from 50° to 100° C., preferably from 80° to 100° C., during from 5 to 960 min., preferably from 60 to 360 min. The pulp concentration may be from 1 to 40%, preferably from 5 to 15%. In preferred embodiments comprising treatment with DTPA in the first step and hydrogen peroxide in the second step, the first step is carried out with an addition of DTPA (100% product) in an amount of from 0.1 to 10 kg/ton pulp, preferably from 0.5 to 2.5 kg/ton, and the second step with a hydrogen peroxide charge of from 1 to 100 kg/ton, preferably from 5 to 40 kg/ton. The process conditions in both treatment steps are adjusted such that the maximum bleaching effect per kilo of charged peroxide-containing substance is obtained.

In the first treatment step, the pH value is adjusted by means of sulphuric acid or residual acid from the chlorine dioxide reactor, while the pH in the second step is adjusted by adding to the pulp alkali or an alkali-containing liquid, for example sodium carbonate, sodium hydrocarbonate, sodium hydroxide, or oxidized white liquor.

The process according to the invention is preferably carried out without the addition of silicates in the second treatment step.

The main difference between the invention and prior art as stated above (the article by Gellerstedt in the Journal of Wood Chemistry and Technology) is that no sulphite is added and an extra addition of chemicals can thus be avoided. In this way, it is possible to obtain a simplified process technology, a less expensive method as well as an improvement with regard to environmental aspects. With $SO_2$ present in the process, the possibility of obtaining a more closed system in the bleach plant is excluded, since this would result in excessive sulphur contents in the liquor inventory, while it is possible to obtain, when there is no $SO_2$ present, a considerably more closed system, thus reducing the environmental problems. This is because the process according to the invention permits recovery from both the first step with a complexing agent and from the second step with hydrogen peroxide, i.e. from a later position in the bleaching sequence compared with the $SO_2$ process. Furthermore, if $SO_2$ is to be recovered to allow for a more closed system, supplementary devices adapted to remove $SO_2$ from the pulping liquor have to be added to the process, which makes it more complicated and expensive. Moreover, with the most favourable embodiment of the invention as to the environment, i.e. when the two-step treatment is carried out after an initial oxygen stage, the chlorine dioxide charge can, depending on the amount of chemicals free from chlorine in the process and upon the desired final brightness, be reduced to such an extent that recovery can be made also from one or more of the stages in the final bleaching sequence D E D, such that an almost completely closed system can be obtained in the bleaching process.

In this embodiment of the invention where the treatment is carried out after an oxygen stage in the bleaching sequence, the two-step treatment gives an excellent lignin-dissolving effect, since an oxygen treated pulp is more sensitive to a lignin-reducing and/or brightness-increasing treatment with hydrogen peroxide. This treatment, used in combination with a complexing agent and carried out after an oxygen stage, thus gives such good results that from an environmental point of view a substantially improved treatment with a more closed system for the bleaching sequence may be obtained. Efforts have also been made to increase the chlorine-free delignification by using two oxygen stages after one another at the beginning of a bleaching sequence. However, it has been found that after an initial oxygen treatment, it is difficult to use a repeated oxygen treatment to remove such amounts of lignin that the high investment costs for such a stage are justified.

When comparing the results of the treatment according to the article by Gellerstedt, and the results of the treatment according to the invention, it has been found that the treatment according to this prior art seems to result in a more complete elimination of the total trace metal content, whereas the treatment according to the invention comprising a first step with only a complexing agent being added under neutral conditions results in a considerable reduction principally of the metals most detrimental to the decomposition of hydrogen peroxide, such as manganese. Thus, it has been found that the more complete elimination of the content of trace metals, being carried out according to the article by Gellerstedt, is not necessary to efficiently carry out the hydrogen peroxide step. On the contrary, certain metals, for example Mg, will even have a favourable effect on, among other things, the viscosity of the pulp, for which reason these metals are advantageously not eliminated. Thus, previous processes have only aimed at reducing the metal content as much as possible, whereas it has been found according to the invention that a trace metal profile altered by a selectively changed metal content will have a more favourable effect on the subsequent hydrogen peroxide treatment.

Furthermore, when examining the quality of the pulp resulting from the previously known process and the process according to the invention, it has been found that the simplified process according to the invention, under controlled pH conditions, gives, depending on the position in the bleaching sequence, better or unchanged results as to the viscosity and kappa number (=a measure of the remaining lignin content) of the pulp, and also as to the hydrogen peroxide consumption. A comparative treatment of an oxygen bleached pulp gives equivalent results, while a comparative treatment of a non-oxygen bleached pulp gives better results with the process according to the invention. Thus, in a bleaching process, the aim is a low kappa number, which means a low content of undissolved lignin, and a high brightness of the pulp. Furthermore, the aim is a high viscosity, which means that the pulp contains long carbohydrate chains resulting in a product with higher strength, and a low hydrogen peroxide consumption resulting in lower treatment costs.

The invention and its advantages are further illustrated by the following examples which, however, are only intended to illustrate the invention and are not intended to limit the same.

EXAMPLE 1

This Example illustrates, for a non-oxygen bleached pulp, the effect of different pH values in step 1 on the efficiency of the hydrogen peroxide treatment in step 2, in a method according to the invention and, for comparative purposes, in a treatment with $SO_2$ (15 kg/ton pulp)+DTPA in step 1. The kappa number, viscosity and brightness of the pulp were determined according to SCAN Standard Methods, and the consumption of hydrogen peroxide was measured by iodometric titration. The treated pulp consisted of a non-oxygen bleached sulphate pulp of softwood, which, before the treatment, had a kappa number of 27.4 and a viscosity of 1302 $dm^3$/kg.

The treatment conditions were:

Step 1: 2 kg/ton DTPA; 90° C.; 60 min.; varying pH

Step 2: 25 kg/ton hydrogen peroxide ($H_2O_2$); 90° C.; 60 min.; final pH=10–11

TABLE I

| Step 1 | pH step 1 | Kappa number step 2 | Viscosity step 2 | Brightness step 2 (% ISO) | $HO_2$ consumption step 2 (kg/ton) |
|---|---|---|---|---|---|
| $SO_2$ + DTPA: | 6.9 | 16.5 | 1093 | 54.0 | 22.1 |
| DTPA: | 6.9 | 16.7 | 1112 | 54.2 | 12.4 |
| $SO_2$ + DTPA: | 7.5 | 16.9 | 1057 | 48.4 | 25 |
| DTPA: | 7.8 | 16.4 | 1112 | 52.7 | 22.4 |
| $SO_2$ + DTPA: | 4.8 | 17.8 | 1026 | 49.2 | 24.3 |

As is apparent from the Table, a two-step treatment according to the invention of a non-oxygen bleached pulp which in the first step is only treated with DTPA, gives better results in the subsequent hydrogen peroxide treatment as to viscosity and consumption of hydrogen peroxide than does a treatment of the same pulp, according to prior art technique comprising also $SO_2$ in the first step. It is furthermore evident that the most favourable results are obtained when pH is changed from slightly acidic (4.8 according to the prior art technique) to neutral (6.5–7.0).

EXAMPLE 2

This Example illustrates, for an oxygen bleached pulp, the effect of different pH values in step 1 on the efficiency of the hydrogen peroxide treatment in step 2, in a method according to the invention and, for comparative purposes, also in a treatment without any added DTPA in step 1 and in a treatment with $SO_2$ (15 kg/ton pulp)+DTPA in step 1. The kappa number, viscosity and brightness of the pulp were determined according to SCAN Standard Methods, and the consumption of hydrogen peroxide was measured by iodometric titration. The treated pulp consisted of an oxygen bleached sulphate pulp of softwood, which, before the treatment, had a kappa number of 19.4 and a viscosity of 1006 $dm^3$/kg.

The treatment conditions were:

Step 1: 2 kg/ton DTPA; 90° C.; 60 min.; varying pH

Step 2: 15 kg/ton hydrogen peroxide ($H_2O_2$); 12 kg NaOH; 90° C.; 60 min.; pH=10.9–11.7

TABLE II

| pH step 1 | Kappa number step 2 | Viscosity step 2 | Brightness step 2 (% ISO) | $H_2O_2$ consumption step 2 (kg/ton) |
|---|---|---|---|---|
| 2.8 | 14.2 | 931 | 44.6 | 15.0 |
| 4.1 | 13.8 | 902 | 47.6 | 14.9 |
| 5.8 | 13.4 | 948 | 57.5 | 8.3 |
| 6.9 | 13.5 | 952 | 58.0 | 7.8 |
| 6.9 | 13.4 | 958 | 57.7 | 7.1 |
| 7.7 | 13.4 | 938 | 57.7 | 9.6 |
| 8.3 | 13.7 | 933 | 56.1 | 10.0 |
| 8.6 | 13.7 | 928 | 55.5 | 11.2 |
| 6.1 (without DTPA) | 15.3 | 910 | 41.7 | 15.0 |
| 6.9 (with $SO_2$ + DTPA) | 13.4 | 945 | 57.5 | 7.9 |

As is apparent from the Table, a hydrogen peroxide treatment without preceding DTPA treatment throughout gives inferior test results than the treatment according to the invention. On oxygen bleached pulp, a hydrogen peroxide treatment preceded by a treatment with $SO_2$+DTPA gives about the same results as the process according to the invention. In this case, the advantages of the invention do not reside in the quality obtained, but in obtained advantages regarding the environment, costs and process technology, as mentioned above.

EXAMPLE 3

This Example illustrates, for an oxygen bleached pulp, the effect of different pH values in step 1 on the efficiency of the hydrogen peroxide treatment in step 2, in a method according to the invention. The kappa number, viscosity and brightness of the pulp were determined according to SCAN Standard Methods, and the consumption of hydrogen peroxide was measured by iodometric titration. The treated pulp consisted of an oxygen bleached sulphate pulp of softwood, which, before the treatment, had a kappa number of 16.9, a viscosity of 1040 $dm^3$/kg and a brightness of 33.4% ISO.

The treatment conditions were:

Step 1: 2 kg/ton EDTA; 90° C.; 60 min.; varying pH

Step 2: 15 kg/ton hydrogen peroxide ($H_2O_2$); 90° C.; 240 min.; final pH=11

The results obtained are shown in the Table below.

TABLE III

| pH step 1 | Kappa number step 2 | Viscosity step 2 | Brightness step 2 (% ISO) | $H_2O_2$ consumption step 2 (kg/ton) |
|---|---|---|---|---|
| 10.8 | 11.3 | 922 | 45.1 | 15.0 |
| 9.1 | 9.80 | 929 | 56.4 | 15.0 |
| 7.7 | 9.00 | 944 | 61.9 | 13.0 |
| 6.7 | 8.76 | 948 | 63.3 | 11.3 |
| 6.5 | 8.57 | 950 | 63.6 | 11.1 |
| 6.1 | 8.26 | 944 | 66.1 | 8.8 |
| 5.8 | 8.53 | 942 | 64.0 | 11.0 |
| 4.9 | 8.52 | 954 | 64.0 | 10.4 |
| 3.8 | 8.97 | 959 | 61.7 | 12.2 |
| 2.3 | 10.8 | 947 | 46.2 | 15.0 |
| 1.8 | 10.6 | 939 | 47.0 | 15.0 |
| 1.6 | 10.4 | 919 | 48.2 | 15.0 |

As is apparent from the Table it is crucial that the treatment in step 1 is carried out within the pH range according to the present invention, to reach the maximum reduction in kappa number and hydrogen peroxide consumption as well as maximum increase in brightness. The selectivity expressed as the viscosity at a specific kappa number is higher with a complexing agent present in step 1. This is valid irrespective of pH value, within the range according to the invention.

EXAMPLE 4

This Example illustrates the effect of a washing step between the first and the second treatment step.

An oxygen bleached sulphate pulp with a viscosity of 1068 $dm^3$/kg and a kappa number of 18.1 was subjected to a two-step treatment according to the invention under the following conditions.

Step 1: DTPA 2 kg/ton; pH=6.9; temp. 90° C.; time 1 h

Step 2: Hydrogen peroxide ($H_2O_2$); 15 kg/ton; NaOH 15 kg/ton; pH=11-11.9; temp. 90° C.; time 4 h The results obtained are shown in the Table below where a treatment without the first step is included for comparative purposes.

TABLE IV

| Treatment | Kappa number (after step 2) | Viscosity (after step 2) | $H_2O_2$ consumption (kg/ton) |
|---|---|---|---|
| No step 1 | 13 | 900 | 15 |
| No washing | 13.3 | 967 | 15 |
| With washing | 10.2 | 1010 | 10 |

As can be seen in the Table, better results are obtained if there is a washing step between the two treatment steps according to the invention. It makes no major difference to the kappa number and the consumption of hydrogen peroxide if trace metals are present in free or complex bound state, but the viscosity is improved when there is a formation of complexes. If the complex bound metals are removed by washing before the treatment with hydrogen peroxide, the viscosity is further improved, and lower kappa number and consumption of hydrogen peroxide are also obtained.

EXAMPLE 5

The metal content of the same pulp as in Example 2 (with a viscosity of 1006 $dm^3$/kg and a kappa number of 19.4) was measured after a treatment according to the first step of the invention with 2 kg/ton DTPA at 90° C. for 60 min. and two different pH values, namely 4.3 and 6.2. The results obtained are shown in the Table below.

TABLE V

| Metal (ppm) | Untreated | After pH 4.3 | After pH 6.2 |
|---|---|---|---|
| Fe | 20 | 13 | 13 |
| Mn | 80 | 19 | 7.5 |
| Cu | 0.6 | 0.5 | 0.5 |
| Mg | 350 | 160 | 300 |

As is evident from the Table, a considerable reduction of above all the manganese content is obtained in the treatment with complexing agents, manganese being especially unfavourable to the hydrogen peroxide step. Furthermore, the magnesium content is not much altered at higher pH values, which is favourable for the subsequent treatment step. Thus, the presence of manganese has a negative effect, while the presence of magnesium has a positive effect on the subsequent hydrogen peroxide treatment.

EXAMPLE 6

This Example illustrates the difference between the lignin-reducing effect of oxygen and hydrogen peroxide respectively on an oxygen-treated mill pulp with a kappa number of 19.4 and a viscosity of 1006 $dm^3/kg$.

The conditions of the treatment with hydrogen peroxide were:

Step 1: 2 kg/ton DTPA (100%); 90° C.; 60 min.

Step 2: pH about 11; 90° C.; varying times and charges of hydrogen peroxide ($H_2O_2$)

TABLE VI

| pH step 1 | $H_2O_2$ charge step 2 (kg/ton) | Kappa number step 2 | Viscosity step 2 | $H_2O_2$ consumption step 2 (kg/ton) | Time step 2 (h) |
|---|---|---|---|---|---|
| 4,0 | 15 | 13.8 | 910 | 14.8 | 1 |
| 7.0 | 15 | 13.5 | 952 | 7.8 | 1 |
| 7.0 | 15 | 10.4 | 940 | 10.3 | 4 |
| 6.9 | 25 | 8.7 | 932 | 15.2 | 4 |

The conditions of a laboratory $O_2$ treatment were:

Step 1: As above

Step 2: pH=11.5–12; 90° C.; 60 min.

TABLE VII

| Kappa number | Viscosity | Partial $O_2$ pressure (MPa) |
|---|---|---|
| 16.6 | 946 | 0.2 |
| 16.6 | 953 | 0.3 |
| 16.5 | 951 | 0.5 |
| 16.4* | 961 | 0.5 |

*(pretreatment with DTPA)

As is apparent from Table VI, a chlorine-free delignification of 30–46% can be achieved at a given hydrogen peroxide charge. A higher degree of delignification (55% at 25 kg $H_2O_2$/ton) is obtained with a greater charge.

From Table VII, however, it is clear that a chlorine-free delignification of about 15% can be achieved, but the degree of delignification cannot be increased with a larger amount of charged $O_2$, since an increase in the partial pressure of the oxygen from 0.2 to 0.5 MPa does not reduce the kappa number any further. An intermediate DTPA treatment step has, in subsequent oxygen treatment, no positive effect on the delignification.

EXAMPLE 7

This Example illustrates the environmental advantages with the process according to the invention, namely that an increased chlorine-free delignification before a chlorine/chlorine dioxide-containing stage makes it possible to substantially reduce the amount of adsorbed organic halogen (AOX) and the amount of chlorides in the waste liquor from the bleach plant, i.e. such parameters which, to a substantial degree, influence the possibility of having a closed system in the bleach plant. The Table below illustrates a comparison between a common bleaching sequence according to prior art technique, O C/D $EP_{(4)}$ D $EP_{(1)}$ D, and the process according to the invention, O Step1 Step2 C/D $EP_{(4)}$ D, where $EP_{(4)}$ and $EP_{(1)}$=alkali extraction stage reinforced with 4 kg and 1 kg, respectively, of hydrogen peroxide per ton of pulp. The other abbreviations are explained on page 3. The pulp is identical with that in Example 2, having a kappa number of 19.4 after delignification with oxygen and 10.2 after treatment according to the invention.

TABLE VIII

| | Prior art technique | | | Process according to the invention | | |
|---|---|---|---|---|---|---|
| % D in C/D: | 15 | 50 | 100 | 50 | 100 | 100 |
| Chlorine (kg/ton): | 22 | 14 | 0 | 10 | 0 | 0 |
| $ClO_2$* (kg/ton): | 22 | 33 | 78 | 25 | 40 | 35 |
| Final brightness (% ISO): | 90 | 90 | 90 | 90 | 90 | 89 |
| Final viscosity ($dm^3/kg$): | 880 | 882 | 891 | 950 | 970 | 978 |
| Total AOX (kg/ton): | 2.9 | 2.3 | 0.95 | 1.2 | 0.5 | 0.35 |

*Total amount of $ClO_2$ in the bleaching sequence (as available chlorine).

As can be seen from the Table, substantially lower values as to the AOX content in the spent bleach liquor are obtained with the process according to the invention, resulting in considerable improvements from an environmental point of view at the same time as a pulp with improved viscosity is obtained.

Example 8

This Example illustrates the effect of different charges of hydrogen peroxide in step 2 on the final brightness and viscosity for pulps, which were not subject to any further bleaching, i.e. a total absence of chlorine-containing chemicals in the entire bleaching sequence. This of course means that no AOX is discharged to the recipient. The viscosity and brightness of the pulps were determined according to SCAN Standard Method. The treated pulps consisted of oxygen delignified sulphate pulps of softwood and hardwood and a sulphite pulp (Mg-base), respectively. The pulp from softwood, which was the same as in Example 3, had a kappa number of 16.9, a viscosity of 1040 $dm^3/kg$ and a brightness of 33.4% ISO before the treatment. The pulp from hardwood had a kappa number of 11.3, a viscosity of 1079 $dm^3/kg$ and a brightness of 48.3% ISO before the treatment. The sulphite pulp had a kappa number of 8.6 and a brightness of 57% ISO before the treatment.

The treatment conditions for the softwood pulp were:

Step 1: 2 kg/ton EDTA; 90° C.; 60 min.; pH=6

Step 2: 90° C.; 240 min.; pH=11; varying amounts of hydrogen peroxide ($H_2O_2$)

TABLE IX

| $H_2O_2$ charge step 2 (kg/ton) | Viscosity step 2 ($dm^3/kg$) | Brightness step 2 (% ISO) |
|---|---|---|
| 15 | 1006 | 66.3 |
| 20 | 997 | 69.2 |
| 25 | 968 | 71.6 |

The treatment conditions for the hardwood pulp were:

Step 1: 2 kg/ton EDTA; 90° C.; 60 min.; pH=4.6

Step 2: 90° C.; 240 min.; pH=11; varying amounts of hydrogen peroxide ($H_2O_2$)

TABLE X

| $H_2O_2$ charge step 2 (kg/ton) | Viscosity step 2 ($dm^3/kg$) | Brightness step 2 (% ISO) |
|---|---|---|
| 10 | 1040 | 73.5 |
| 15 | 1031 | 77.0 |
| 20 | 1022 | 79.8 |

TABLE X-continued

| $H_2O_2$ charge step 2 (kg/ton) | Viscosity step 2 ($dm^3$/kg) | Brightness step 2 (% ISO) |
|---|---|---|
| 25 | 1005 | 80.4 |

The treatment conditions for the sulphite pulp were:
Step 1: 2 kg/ton EDTA; 50° C.; 45 min.; pH=5.0
Step 2: 80° C.; 120 min.; pH=10.8; varying amounts of hydrogen peroxide ($H_2O_2$)

TABLE XI

| $H_2O_2$ charge step 2 (kg/ton) | Brightness step 2 (% ISO) |
|---|---|
| 2 | 64 |
| 5 | 74 |
| 10 | 81 |
| 15 | 85 |
| 22 | 87 |

As is apparent from the Tables, with a treatment according to the invention without subsequent final bleaching, it is still possible to produce semi-bleached pulps with a brightness of approximately 70, 80 and 85% ISO, for the softwood, hardwood and sulphite pulp, respectively. These results are achieved in a bleaching process, where the problem with formation and discharge of AOX is eliminated.

A two-step treatment according to the invention of a pulp results, due to the first treatment step, in a favourably altered trace metal profile in the pulp (Example 5), such that it is possible to use the hydrogen peroxide in the subsequent step to increase the chlorine-free delignification, especially if there is a washing step between the two treatment steps (Example 4). In relation to prior art technique, environmental advantages are obtained as well as improvements as to process technology and costs and, depending on the position in the bleaching sequence, a better (Example 1) or unchanged (Example 2) quality of the pulp. Furthermore, with an oxygen prebleached pulp, the parameters relevant to the environment in the spent bleach liquor can be substantially improved (Example 7) to such an extent that it is possible to have a substantially closed system in the bleach plant. By reducing the demand for a brightness level of 90% ISO down to say 70 to 80% ISO, it is possible to completely extinguish the formation and discharge of AOX (Example 8). A comparison between a hydrogen peroxide stage and another oxygen stage (Example 6) shows that oxygen treated mill pulp is more sensitive to hydrogen peroxide treatment than to a further treatment with oxygen for the purpose of both delignification and increased brightness.

We claim:

1. A process for bleaching chemically delignified lignocellulose-containing pulp, comprising, before a peroxide-containing step, the steps of:

(a) treating the pulp for at least one minute in a non-delignifying step with a nitrogenous polycarboxylic acid, thereby altering the trace metal profile of the pulp, said treating step being carried out in the absence of sulfite, at a pH in the range from 3.1 up to 9.0, and at a temperature in the range from 40° C. up to 100° C.;

(b) removing the metals complex bound to the nitrogenous carboxylic acid from the pulp by washing; and subsequently (c) bleaching the pulp from step (b) with a peroxide-containing substance at a pH in the range from 7 up to 13.

2. A process according to claim 1, further comprising bleaching the pulp in an oxygen bleaching stage.

3. A process according to claim 2, wherein the oxygen bleaching stage is prior to the non-delignifying treatment step (a)

4. A process according to claim 1, wherein treatment step (a) is carried out at a pH of from 4 to 8.

5. A process according to claim 4, wherein treatment step (a) is carried out at a pH of from 6 to 7.

6. A process according to claim 1, wherein the nitrogenous polycarboxylic acid id diethylenetriaminepentaacetic acid or ethylenediaminetetraacetic acid.

7. A process according to claim 1, wherein the peroxide-containing substance of delignifying step (c) is hydrogen peroxide or a mixture of hydrogen peroxide and oxygen.

8. A process according to claim 1, further including (d) bleaching the treated pulp from delignifying step (c) in a final bleaching stage to obtain a desired brightness.

9. A process according to claim 1, wherein non-delignifying treatment step (a) is carried out for a period of from 1 to 360 minutes, and delignifying step (c) is carried out at a temperature of from 50° to 130° C. for a period of from 5 to 960 minutes, and the pulp has a concentration of from 1 to 40% by weight.

* * * * *